US007101230B2

(12) United States Patent
Ma

(10) Patent No.: US 7,101,230 B2
(45) Date of Patent: Sep. 5, 2006

(54) COMBINED CONNECTOR

(75) Inventor: Xuedong Ma, Jiangsu (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/545,155

(22) PCT Filed: Mar. 9, 2004

(86) PCT No.: PCT/US2004/007338

§ 371 (c)(1),
(2), (4) Date: Aug. 10, 2005

(87) PCT Pub. No.: WO2004/086566

PCT Pub. Date: Oct. 7, 2004

(65) Prior Publication Data

US 2006/0166562 A1 Jul. 27, 2006

(30) Foreign Application Priority Data

Mar. 21, 2003 (CN) ..... 03 2 38873

(51) Int. Cl.
*H01R 24/04* (2006.01)
*H01R 13/40* (2006.01)

(52) U.S. Cl. ..... 439/668; 439/910

(58) Field of Classification Search ..... 439/668, 439/669, 108, 910, 540.1
See application file for complete search history.

(56) References Cited

U.S. PATENT DOCUMENTS 4,598,970 A * 7/1986 Takihara ..... 439/668
4,867,708 A * 9/1989 Iizuka ..... 439/668
6,224,408 B1 * 5/2001 Wu ..... 439/188
6,478,594 B1 * 11/2002 Curtin et al. ..... 439/188

* cited by examiner

*Primary Examiner*—Tho D. Ta
(74) *Attorney, Agent, or Firm*—Stephen Z. Weiss

(57) ABSTRACT

A combined connector comprising an insulative housing and a plurality of terminals. The insulative housing has a mating face and a rear face connecting with two opposite top face and bottom faces, and defines a plurality of terminal insertion slots. Each terminal comprises a mounting portion and a soldering portion. The mounting portions are received in the terminal insertion slots, and the soldering portions are exposed out of the terminal insertion slots and separately located below the bottom face. The housing further having a hollow portion extending through the top face to the bottom face and corresponding to the soldering portions below the bottom face. The hollow portion allows for the easy inspection of the solder joint quality of the terminals under the housing. The terminals are fixed only by the base portions of the mounting portions thereof to reduce the overall dimension of the connector.

8 Claims, 6 Drawing Sheets

COMBINED CONNECTOR

FIELD OF THE INVENTION

The present invention relates to a combined connector, and more particularly relates to a connector that has combined functions such as an earphone, a charging unit and a microphone of a communication device.

BACKGROUND OF THE INVENTION

With the quick development of mobile phones in recent years, most people favor the mobile phone because it exceeds the location limitations of the wired phone. Regarding the carrying of the mobile phone, users commonly like small light weight configurations. Therefore, the design is directed to the reduction of size and weight of every component so as to reduce the over all size and weight of the mobile phone. At the same time there must be good conductive connections between all of the electrical components to maintain the quality of the signal transmission and reception. As is will known a mobile phone must provide electrical connections for an earphone, a charger and a microphone.

Referring to FIG. 1, a combined connector in the prior art includes an insulative housing 5, a charging contact unit 7, an earphone contact unit (not shown) and a microphone and its contact unit (not shown). The insulative housing 5 is integrally designed with a flat outer surface 50. The charging contact unit 7 includes terminals with varied types of structure and configuration and is received in the housing 5. The housing 5 has a mating surface 51 for engagement by a mating connector of a charger to engage the charging contact unit 7.

The above-mentioned prior art connector, includes a housing used for positioning and fixing the different types of terminals. The number of the terminals are increased as the functions provided by the connector are increased. Soldering of the terminals to a printed circuit board is difficult for the portions of some of the terminals which are located between the bottom of the housing and the printed circuit board. For the hard to locate terminals, solder joint quality is difficult to control, and depends upon the control of time and temperature. It is also difficult to inspect solder joints hidden between the housing bottom and the printed circuit board. As shown above the combined connector in the prior art is too large and the quality of the solder joint is difficult to maintain.

SUMMARY OF THE INVENTION

The main object of the present invention is to provide a combined connector having terminals which can be firmly soldered to a printed circuit board and can be easily inspected. Another object is to provide a combined connector having an insulative housing that is light in weight and has reduced dimensions.

To fulfill the above-mentioned objects, the present invention provides a combined connector, which is disposed in a communication device to electrically connect to a circuit board and conductively contacting with an external mating connector. The combined connector comprises an insulative housing and a plurality of terminals. The insulative housing has a mating face located between opposed to and bottom faces, and defines a plurality of terminal insertion slots. Each terminal comprises a mounting portion and a soldering portion. The mounting portion of each terminal is received in a respective terminal insertion slot. The soldering portions pass through the terminal insertion slots and are located behind the rear face and below the bottom face. The housing further defines a hollow portion extending through the top face to the bottom face and corresponds to the soldering portions which are located below the bottom face. With this configuration the solder joint between the terminals and the circuit board can be visually inspected easily.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

To be better understood the technology content, feature and function of the present invention, a preferred embodiment of the present invention will be described in detail below in conjunction with the drawings.

Figure 1:
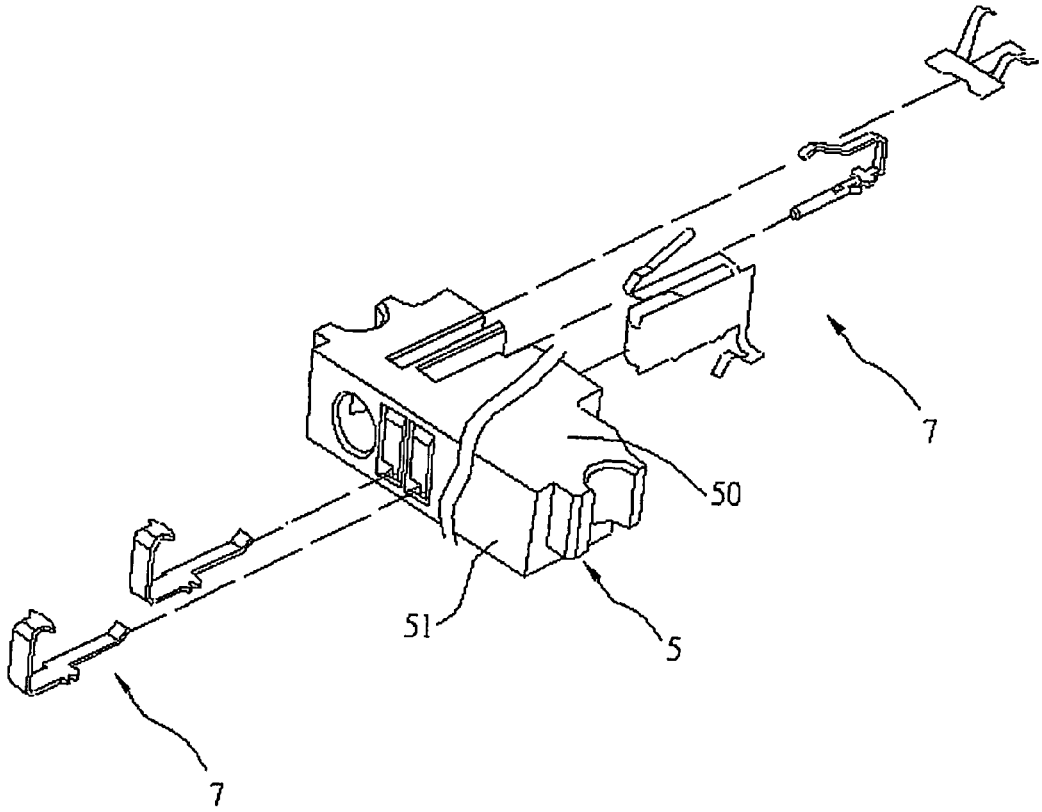
FIG.1 PRIOR ART
FIG. 1 is a partial exploded perspective view of a combined connector in the prior art.
Figure 2:
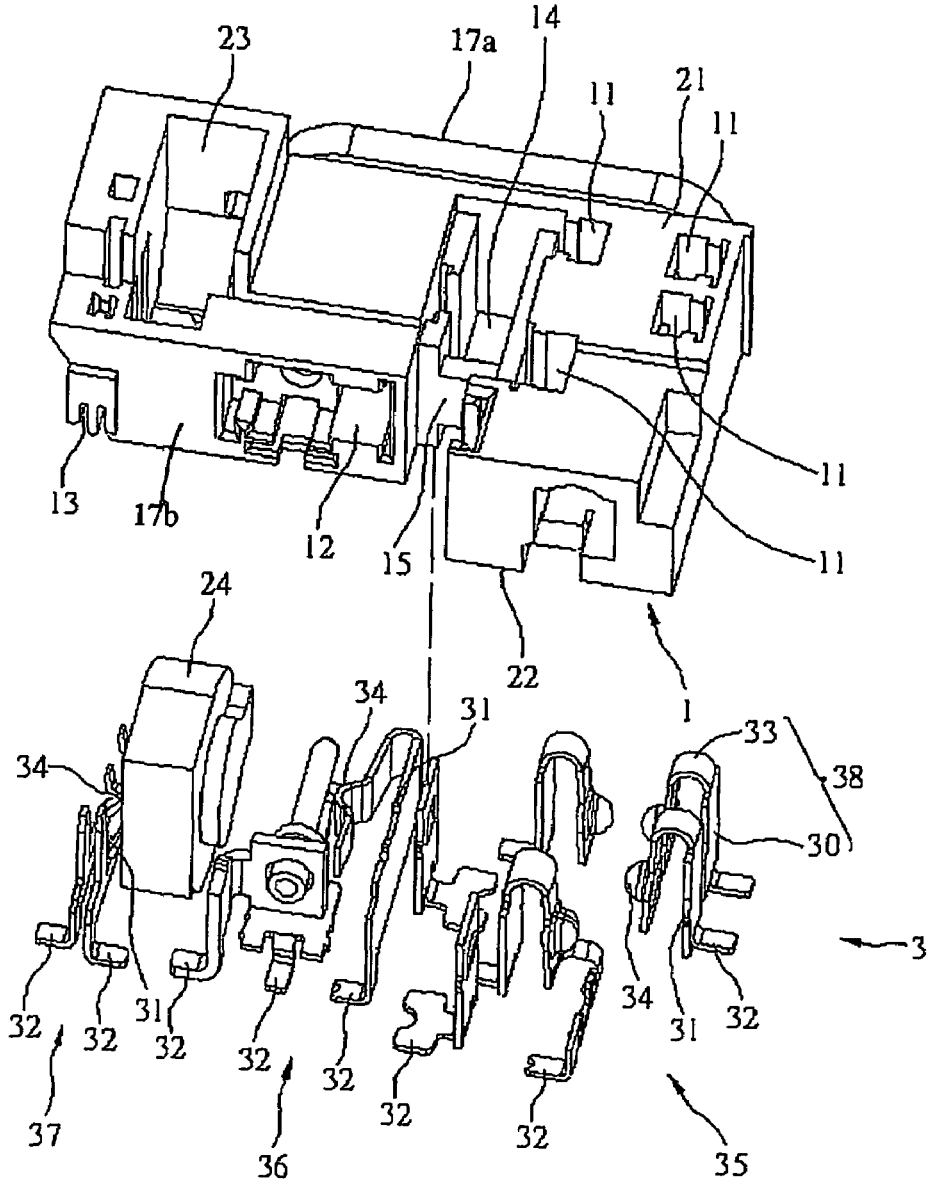
FIG. 2 is an exploded perspective view of a combined connector of the present invention.
Figure 3:
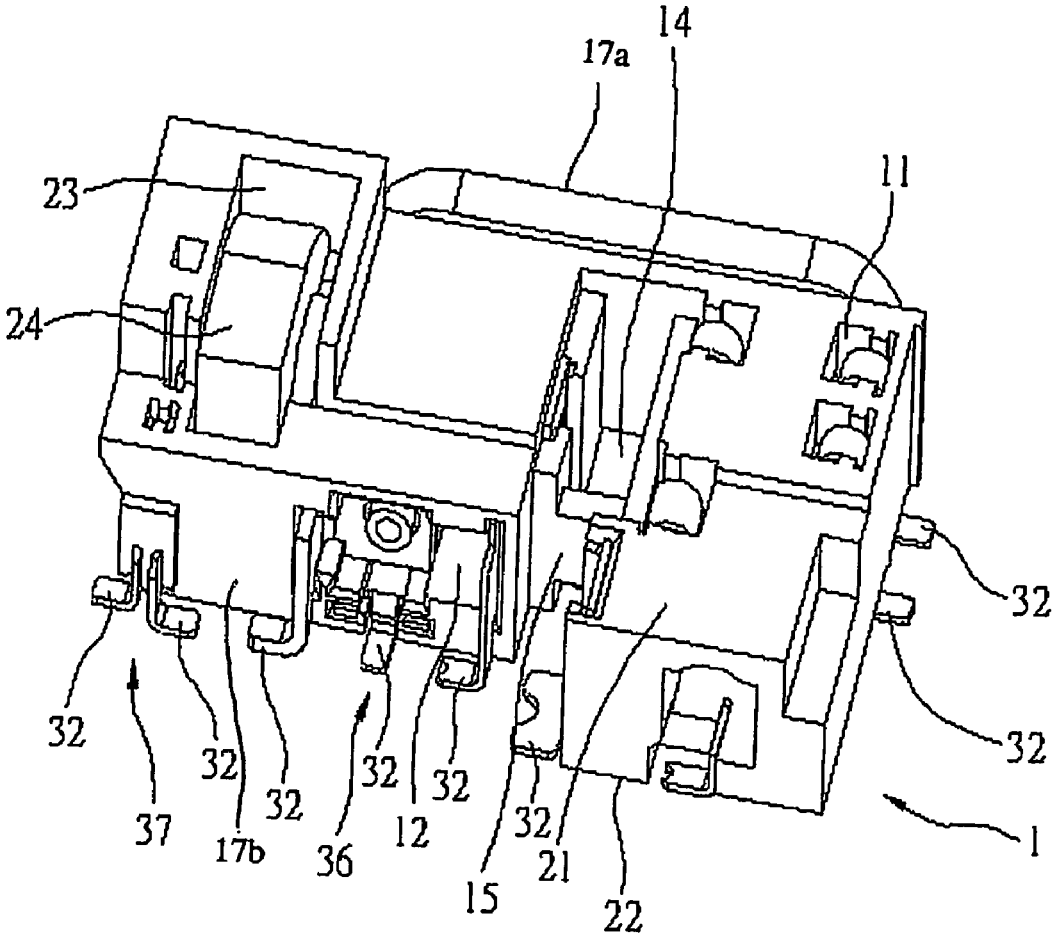
FIG. 3 is an assembled perspective view of the rear of the combined connector of the present invention.
Figure 4:
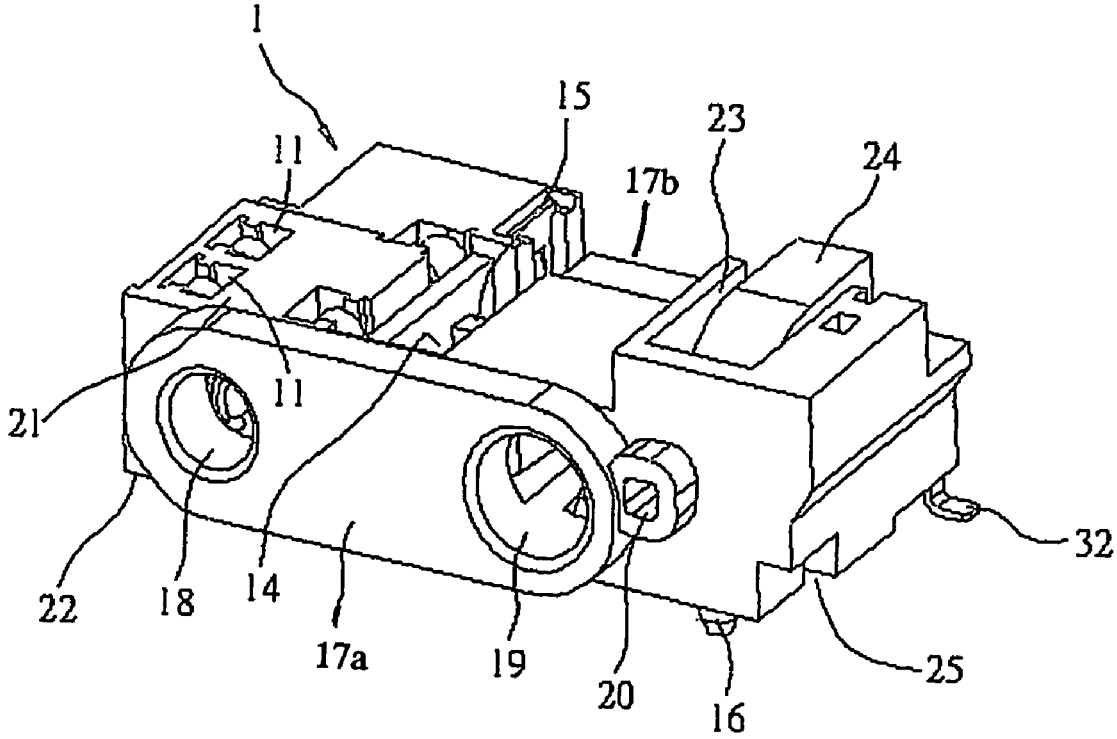
FIG. 4 is an assembled perspective view of the front of the combined connector of the present invention.
Figure 5:
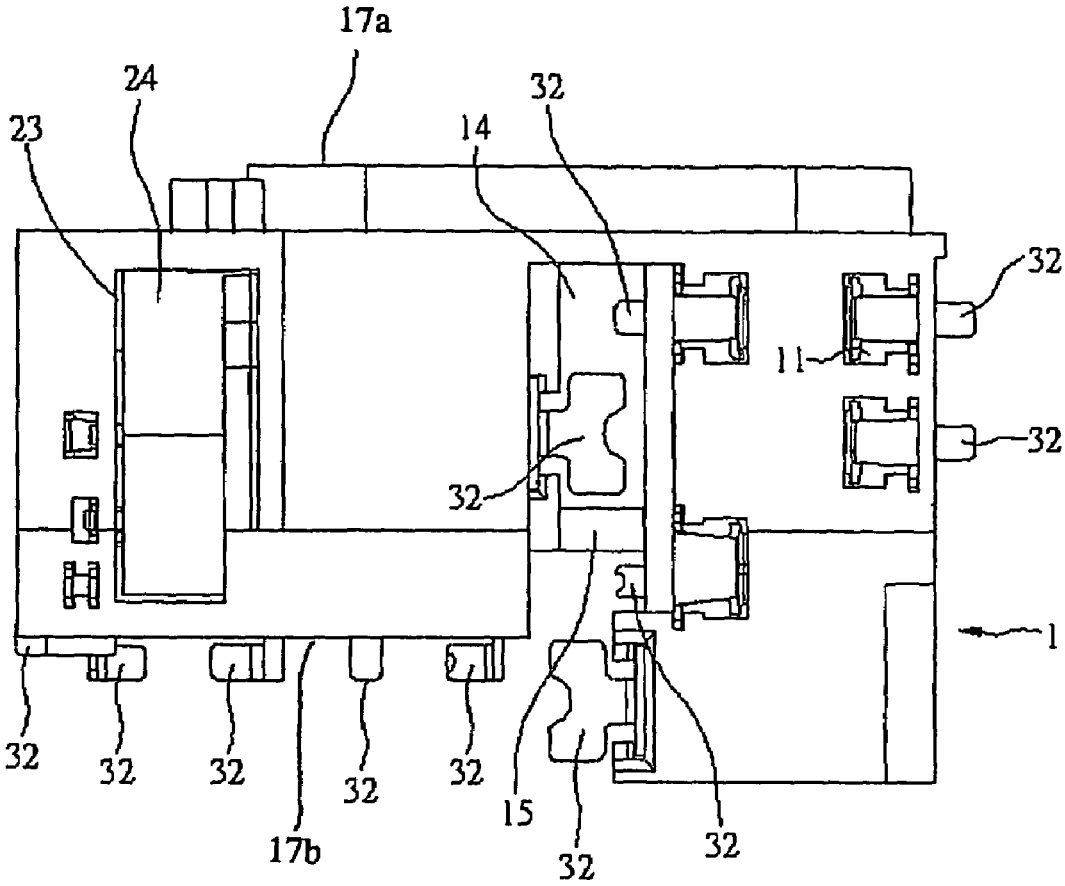
FIG. 5 is a top view of the combined connector of the present invention.
Figure 6:
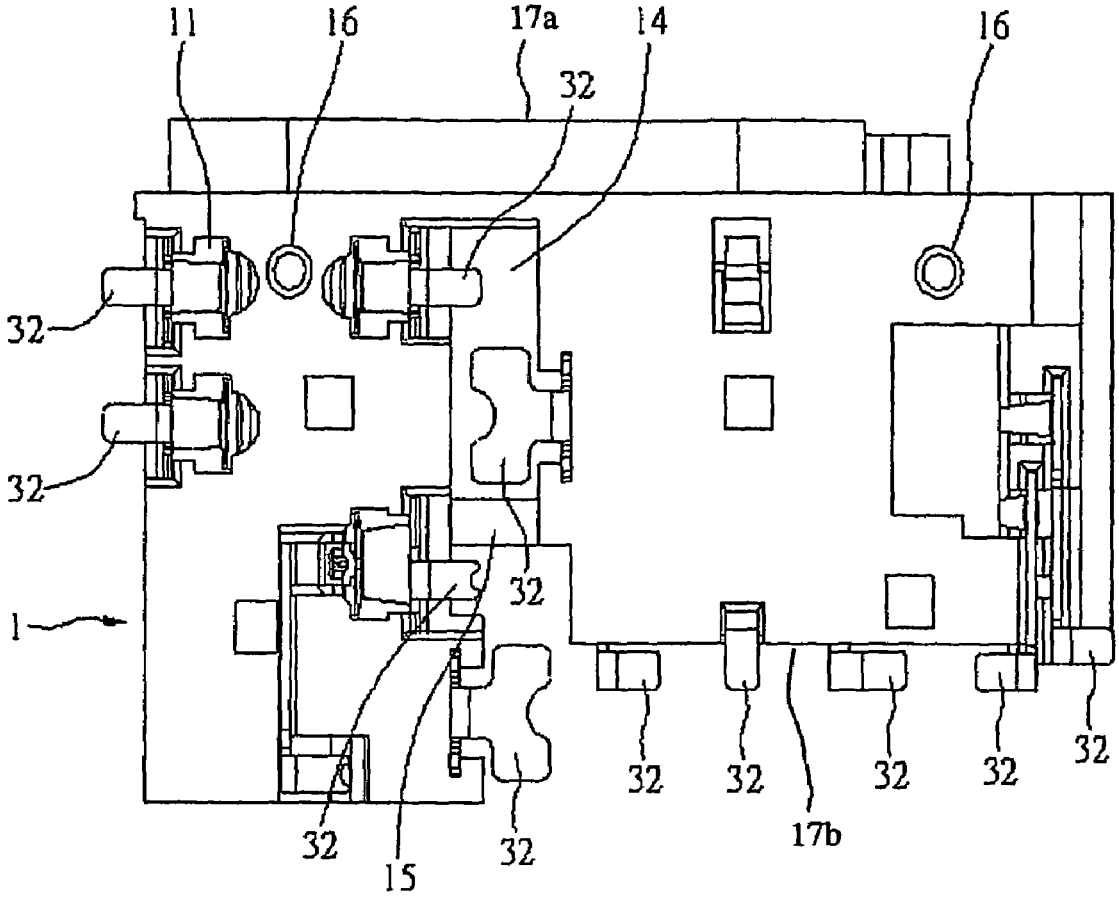
FIG. 6 is a bottom view of the combined connector of the present invention.

Referring to FIGS. 2 to 6, a combined connector of the present invention is disposed in a communication device where its terminals are soldered to a printed circuit board. The housing 1 has a mating face 17*a* and an opposed rear face 17*b* which are joined with a top face 21 and a bottom face 22, which are opposed to each other. The housing 1 defines several terminal insertion slots 11, 12 and 13, an earphone hole 18, a charge hole 129 and a microphone hole 20. The bottom face 22 further forms a projecting post 16 which is used to position the housing 1 to the printed circuit board (not shown).

The plurality of terminals are provided each comprising a mounting portion 38 and a soldering portion 32. The mounting portions 38 of the terminals are received in the terminal insertion slots 11, 12, and 13. The soldering portions 32 are exposed outside of the terminal insertion slots 11, 12, and 13 and are located below the bottom face 22 behind the rear face 17*b* to be soldered to the printed circuit board. The housing 1 further defines a hollow portion 14 extending through the top face 21 to the bottom face 22, and corresponding to the soldering portions 32 below the bottom face 22. The housing 1 further forms a rib 15 located in the hollow portion 14 to strengthen the structure of the housing 1.

The terminals form an audio frequency contact unit 35, a charging contact unit 26 and a microphone contact unit 37. The mounting portions of the terminals each have a base portion 39 which includes interfering tabs 31. One end of the base portion 30 is formed with a resilient arm 33 where the free end of the resilient arm 33 has a contacting portion 34. The other end of the base portion 30 has a soldering portion 32.

Openings of the terminal insertion slots 11 of the housing 1 are located in the bottom face 22, and the audio frequency contact unit 35 is disposed in the terminal insertion slots 11 and fixed to the terminal insertion slots 1 by the interfering tabs 31. The earphone hole 18 of the mating face 17*a* communicates with the terminal insertion slots 11. The external mating connector comprises a mating earphone connector (not shown), which is inserted into the earphone hole 18 and electrically engages the contacting portions 34 of the terminals of the audio frequency contact unit 35.

Openings of the terminal insertion slots 12 of the housing 1 are located in the rear face 17*b* of the housing and the charging contact unit 65 is disposed in the terminal insertion slots 12 and fixed in the terminal insertion slots 12 by the interfering tabs 31. The charge hole 19 of the mating face 17*a* communicates with the terminal insertion slots 12. The external mating connector comprises a mating charge connector (not shown), which is inserted into the charge hole 19 and electrically engages the contacting portions 34 of the terminals of the charging contact unit 36.

Openings of the terminal insertion slots 13 of the housing 1 are located in the bottom face 22, and the microphone contact unit 37 is disposed in the terminal insertion slots 13 and are fixed to the terminal insertion slots 13 with the interfering tabs 31. The housing 1 further defines a receiving slot 23 to receive a microphone 24. The microphone hole 20 of the mating face 17*a* communicates with the receiving slot 23 and corresponds to the audio hole of the microphone 24. Electrical contact points of the microphone 24 electrically engage the contacting portions 34 of the terminals of the microphone contact unit 37.

The soldering portions 32 of the terminals of the combined connector extend below the bottom face 22, and are located within the area of the periphery of the bottom face 22 and the hollow portion 14. This will allow for the easy inspection of the solder joint between the terminals and the printed circuit board. The terminals are fixed in the terminal insertion slots 11, 12, and 13 only by the interfering tabs 31 of the base portion 30. The housing 1 fixes the terminals without the need for other materials so that the height between the top face 21 and the bottom face 22 is reduced resulting in the overall dimensions and the weight of the connector being reduced due to the hollow portion 14.

The mating face 17*a* of the housing 1 further defines a cutout 25 adjacent to the bottom face 22. The cutout 25 receives soldering portions of edge terminals of a MINI USB (not shown), for saving required space of the whole combination and increasing the function of the combined connector.

Although several embodiments of the present invention have been illustrated and described, it is not intended to limit the present invention to these embodiments. Rather, a person skilled in the art can make various changes to these embodiments without departing from the spirit and scope of the present invention. So, what the present invention intends to protect is based on the claims defined by the present application.

What is claimed is:

1. A combined connector being disposed in a communication device to be electrically connected to a printed circuit board, comprising:

an insulative housing having a mating face and an opposed rear face, the mating and rear faces being connected together by a top face and a bottom face, a plurality of terminal insertion slots, and a hollow portion extending through the top face to the bottom face and a plurality of terminals, each terminal comprising a mounting portion and a soldering portion, the mounting portion of the terminals received in the terminal insertion slots, the soldering portions extending out of the terminal insertion slots, below the bottom face, and corresponding to the hollow portion so that a solder joint between the terminal soldering portions and the board can be easily inspected.

2. The combined connector of claim 1, wherein the insulative housing further defines a rib portion located in the hollow portion.

3. The combined connector of claim 1, wherein the bottom face of the housing further defines a cutout, and the cutout receives a soldering portion of an edge contact of a MINI USB.

4. The combined connector of claim 1, wherein a projecting post is further formed on the bottom face of the housing and designed to be inserted into an aperture in the printed circuit board.

5. The combined connector of claim 1, wherein the housing further has a second opening in the rear face of the housing designed to receive a charging contact unit, the mating face further including a charging hole communicating with the second opening, the charging hole designed to received a mating charge connector from the mating connector to electrically engage the charge connector terminal with the terminal of the charging contact unit.

6. The combined connector of claim 1, wherein the housing further has a third and forth opening located at the bottom face and includes a microphone contact unit inserted into the third opening and a microphone inserted into the forth opening, the mating face further including a microphone hole communicating with the third opening and corresponding to an audio hole of the microphone, terminals of the microphone being designed to engage contact portion of the terminals of the microphone contact unit.

7. The combined connector of claim 1, wherein the bottom face of the housing further has first openings to receive an audio contact unit, the mating face of the housing further including an earphone hole which communicates with the opening and designed to receive an earphone connector so that terminals of the ear phone connector electrically engages the terminals of the audio contact unit.

8. The combined connector of claim 7, wherein the terminals each having a base portion and the interfering tabs on the base portion mechanically engaging within the terminal insertion slots wherein a resilient arm extend from one end of the base portion and a soldering portion extends from an end of the base portion opposite the end from which the resilient arm extends.

* * * * *